United States Patent [19]

Hodge

[11] 4,342,125

[45] Aug. 3, 1982

[54] WATER LEVEL CONTROL FOR SWIMMING POOLS

[75] Inventor: George R. Hodge, 8528 SE. Merrit Way, Jupiter, Fla. 33458

[73] Assignees: G. Robert Hodge; Louise S. Hodge, both of Jupiter, Fla.

[21] Appl. No.: 167,126

[22] Filed: Jul. 9, 1980

[51] Int. Cl.[3] ..... E04H 3/18

[52] U.S. Cl. ..... 4/508; 137/430

[58] Field of Search ..... 4/488, 508, 506, 507, 4/496, 509, 510; 73/305, 306; 137/386, 430

[56] References Cited

U.S. PATENT DOCUMENTS

| | | | |
|---|---|---|---|
| 1,800,378 | 4/1931 | Everson | 4/508 X |
| 2,809,752 | 10/1967 | Leslie | 4/508 X |
| 3,739,405 | 6/1973 | Schmidt | 4/508 |
| 3,848,627 | 11/1974 | Page | 4/508 X |
| 3,908,206 | 9/1975 | Grewing | 4/508 |
| 3,997,925 | 12/1976 | Hough | 4/508 |
| 4,133,058 | 1/1979 | Baker | 4/508 X |
| 4,265,598 | 5/1981 | Brand | 4/508 X |

*Primary Examiner*—Stuart S. Levy
*Attorney, Agent, or Firm*—Howard E. Thompson, Jr.

[57] ABSTRACT

A water level control for swimming pools is provided in the form of a casing for suspension on a ladder, pool wall, or pool edge having a float-controlled valve detachably coupled with a pressure water supply and adapted to open as the float drops a predetermined distance within the range of about ¾ inch to 1 inch, said casing having a transverse partition intermediate its upper and lower ends which supports the valve and float assemblage, and said partition and casing bottom being apertured to permit egress of water fed through the valve while in open position while at the same time acting as baffles to maintain an essentially stable water level within the casing in spite of the wave action which may prevail in the surface of the pool water. Positioning of the casing is facilitated by external high and low water level markings which align with the water levels within the casing at the upper and lower limits of float movement.

5 Claims, 3 Drawing Figures

WATER LEVEL CONTROL FOR SWIMMING POOLS

This invention relates to a water level control for swimming pools and similar bodies of water in which normal use of the body of water may be creating waves at the surface and in which there is a need for maintaining a minimum variation between the high and low undistributed or average water levels.

The need is particularly significant in swimming pools equipped with skimmers which form part of the water recirculating system and which conventionally involve an opening in the pool side through which surface water can be drawn and which normally extends about 2½ to 3 inches above and 2½ to 3 inches below the desired high water level. These dimensions permit the skimmer to function properly during periods of pool use when the surface of the water may be very choppy as a result of such use.

Pool skimmers generally include flapper floats hinged to the lower portion of the opening which tend to stabilize water level within the skimmer by freely letting water pass from the pool to the skimmer while retaining the reverse flow. The flapper float, however, somewhat restricts the lower portion of the skimmer opening and can become nonfunctional if the level of water in the pool falls too far below the high level normally desired which is about midway between upper and lower edges of the skimmer opening.

If such a drop in the level of the pool water occurs while the water circulating system is in operation, it can cause malfunctioning of the system because of air being drawn into the system through the skimmer line. Thus the problem of a dropping water level in the pool is a very real one and is contributed to by several factors. Any leak in the pool or circulating system will, of course, cause a gradual lowering of the water level, and warm weather, particularly associated with low humidity, causes substantial water loss and lowering of pool level through evaporation. In addition there is substantial water loss through boisterous use of a pool with water splashing over the sides and being carried out by bathers.

In the management of large commercial and institutional pools, the maintaining of a proper water level in the pool is but one of many factors attended to by trained maintenance personnel, but in thousands of smaller residential pools and the like, where trained maintenance personnel are not available, the criticality of maintaining a proper water level in the pool is frequently overlooked.

An object of the present invention is to provide a simple and inexpensive device which can be permanently coupled with a pressure water feed and which will automatically be activated to add water to the pool when the water level has dropped a predetermined distance below the desired water level, which as earlier mentioned in approximately midway between upper and lower edges of the skimmer opening.

Regarded in certain of its broader aspects, the water level control for swimming pools in accordance with the present invention comprises a casing for suspension on a ladder, pool wall, or pool edge having a float-controlled valve detachably coupled with a pressure water supply and adapted to open as the float drops a predetermined distance within the range of about ¾ inch to 1 inch, said casing having a transverse partition intermediate its upper and lower ends which supports the valve and float assemblage, and said partition and casing bottom being apertured to permit egress of water fed through the valve while in open position while at the same time acting as baffles to maintain an essentially stable water level within the casing in spite of the wave action which may prevail in the surface of the pool water.

Float-controlled valves of the type suitable for the use in the present invention are commercially available from various sources, one such source being Fluidmaster, Inc., of Aniheim, Calif. Valves such as FLUIDMASTER Model 200-A, although primarily intended as toilet tank fluid level control valves, are ideally suited for use in the present invention by merely disconnecting and not utilizing the refill tube which would constitute part of a toilet tank installation.

The FLUIDMASTER Model 200-A valve can be preset to respond to movements of the float within the above-mentioned range of ¾ inch to 1 inch, and this range of float movement will, of course, have a predetermined relationship to or vertical spacing from the casing partition which supports the valve and float assemblage. Having established these vertical distances, the outer surface of the casing is embossed or otherwise marked with the predetermined high and low water levels, thereby facilitating accurate vertical orientation of the casing when installing the same in the pool.

As many residential pools are provided with ladders, it can be practical in such instances to mount the unit to one of the ladder rails or ladder steps. On the other hand, in concrete or masonary pools the unit can readily be mounted directly to the pool wall, or in pools equipped with a vinyl liner the unit can be mounted on a bracket secured to and suspended from the pool coping or decking.

When installed in a pool at the time of building, the water supply to which the unit is attached can readily be laid through or under the decking, whereas in established pools the water supply can be simply a hose extending across the pool decking coupled to the unit.

The water level control as above described has been tested for some time in a Florida pool where water loss through evaporation is very pronounced during the summer months, and it is found that with the unit properly installed and coupled with a pressure water source, the desired water level in the pool is readily maintained and the problem of skimmer malfunctioning is completely eliminated.

The water level control of the present invention will be more fully understood from a consideration of the following description, having reference to the accompanying drawing in which preferred adaptations have been illustrated in the several views, and in which.

Figure 1:
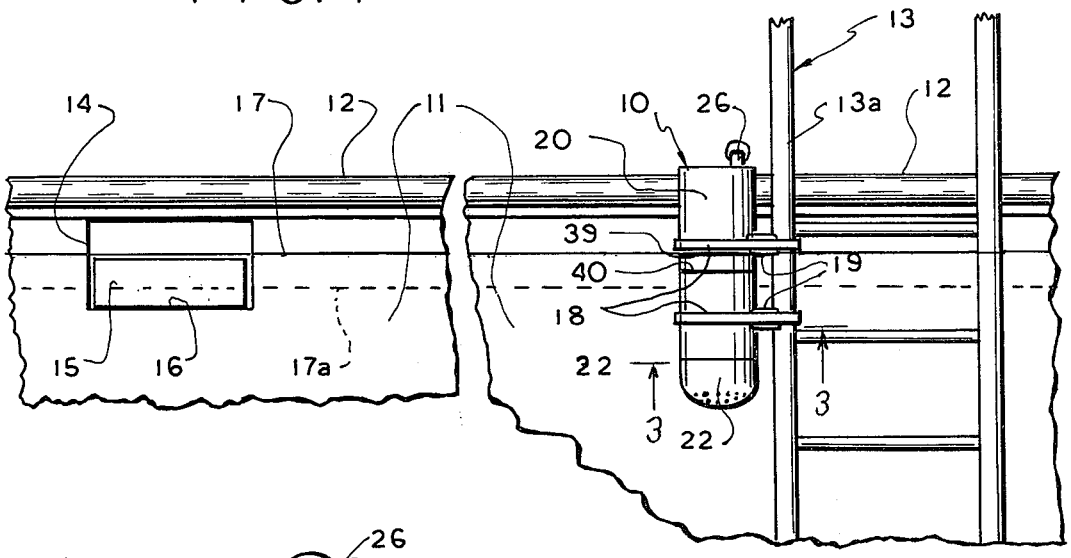
FIG. 1 is a fragmentary and broken view of portions of a pool edge in elevation showing a typical mounting of the water level control in the pool.

As shown in FIG. 1 of the drawing, the water level control 10 of the present invention is associated with a conventional pool having side walls 11 topped by deck or coping 12 with a ladder 13 being mounted to the deck 12 at one location and a skimmer opening 14 being situated in the upper portion of the pool wall 11 at some distance from the ladder 13. The skimmer mechanism which forms no part of the present invention is mounted in a conventional way beneath the deck 12 with the skimmer opening 14, generally rectangular, having a rectangle float 15 hinged at its bottom edge 16 to permit free rise and fall of the float as waves in the pool vary the water level in the vicinity of the skimmer opening 14.

For proper operation of the skimmer the level of water in the pool, when at rest, should preferably be between an upper level 17 which is approximately aligned with the vertical mid point of the skimmer opening 14 and a lower level 17*a* at which time float 15 still remains functional and which is generally about 1 to 1½ inches below the high level 17. If the pool water level were to drop substantially below the indicated low level 17*a* so that the float 15 becomes fully depressed and no longer functional, the skimmer mechanism will no longer receive enough water through the skimmer opening 14, and the resulting pumping of air can seriously interfere with proper recirculation of pool water and cause possible damage to the pump, filter and other components of the circulating system.

Figure 3:
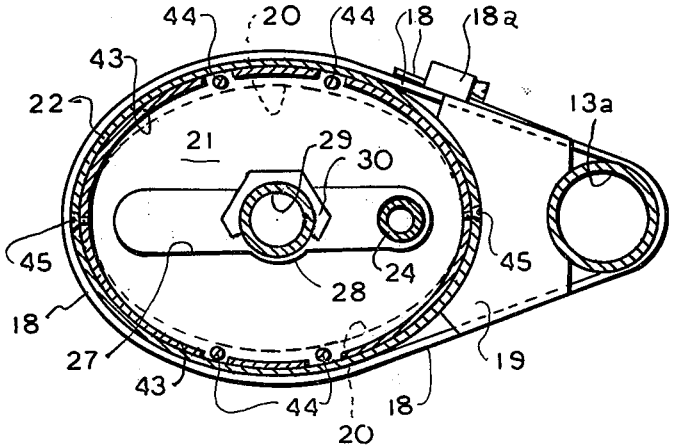
FIG. 3 is a sectional view through the water level control and mounting taken substantially on the line 3—3 of FIG. 2 and the broken line 3—3 of FIG. 1.

The water level control of the present invention which is intended and adapted to automatically maintain the pool water level between the high and low levels 17, 17*a*, can be mounted in the pool by various means such as direct attachment to the pool wall 11, suspension from the deck or coping 12 or mounting to the ladder 13. The ladder mounting is preferred from the standpoint of safety as providing a minimum obstruction to active use of the pool by swimmers. Accordingly, as shown in FIGS. 1 and 3 of the drawing, the water level control unit 10 has been shown as mounted to the side rail 13*a* of a ladder by adjustable straps 18 with the unit 10 being spaced from the ladder rail 13 by appropriately form fitting spacers 19. The straps 18 can suitably be of the flexible metal type in which a transversely notched end is adjustably engaged by a worm gear mechanism 18*a*. It is noted that the spacers 19 should be of such size that the spacing 19*a* as shown in FIG. 3 permits free hand gripping of the ladder rail 13*a* at points in alignment with the unit 10.

Figure 2:
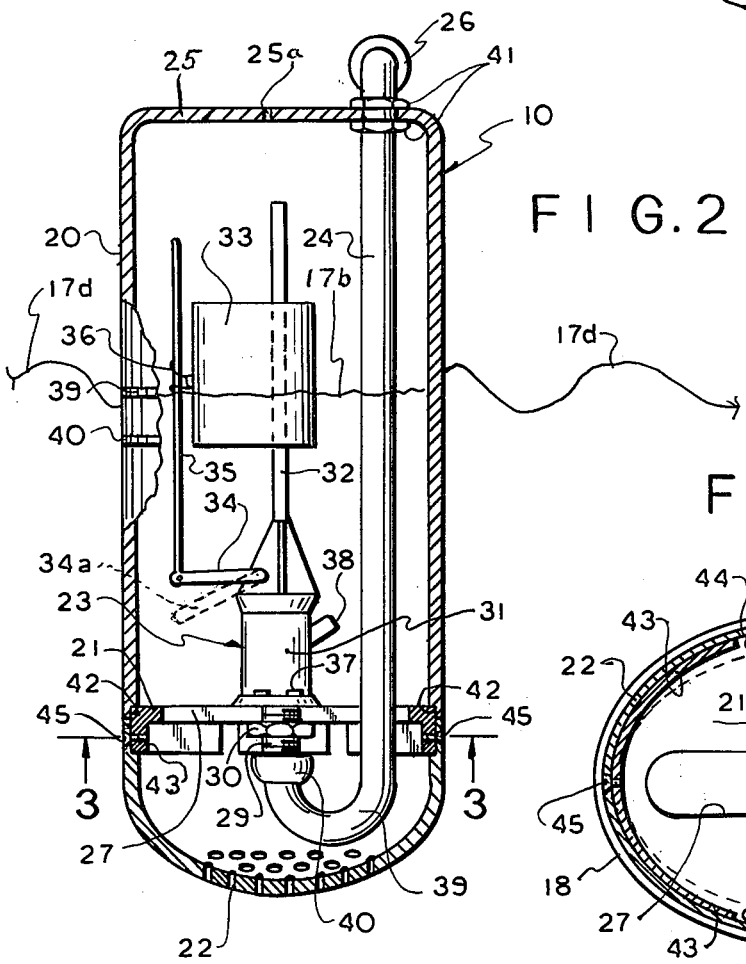
FIG. 2 is an enlarged sectional view of the water level control as shown in FIG. 1 illustrating internal structure and mounting of components in the water level control.

As shown in FIGS. 2 and 3, the water level control unit 10 comprises a vertically elongated outer casing 20 having an apertured partition 21 closely spaced from an apertured bottom wall 22. The partition 21 supports a ball cock valve mechanism 23 which is connected by internal piping 24 extending upwardly through top wall 25 of the casing to a coupling means 26 for connecting the unit with a pressure water supply.

As more clearly shown in FIG. 3, the partition 21 has an elongated aperture 27 of a width to freely accommodate piping 24 and having lateral central offsets 28 for closely engaging and positioning a downwardly protruding threaded portion 29 of the ball cock assemblage. A nut 30 adjustably movable on the threaded portion 29 serves to firmly clamp the ball cock valve assemblage 23 to the partition 21.

The ball cock valve assemblage 23 is not new per se, and various commercially available valve assemblages of the type frequently used in controlling the water level of toilet tanks and the like can be employed. A preferred type of valve assemblage is the Model 200A fluid level control valve supplied by FLUIDMASTER, INC. of Anaheim, Calif. and covered by U.S. Pat. No. 3,429,333 and other patents. The basic components of the ball cock mechanism 23 comprise valve chamber 31 having an upwardly extending rail 32 which is a guide for float 33, and having at one side a pivoted lever 34 having pivoted to its outer end a connecting rod 35 which is secured to the float 33 by adjustable clamp 36. The valve chamber 31 has primary water discharges 37 in the lower portion thereof and a secondary angular water discharge 38. The hose connection to discharge 38, which in toilet installations would connect with the overflow pipe, is simply omitted in the present adaptation of the ball cock valve assemblage.

With this type of ball cock valve a change in water level of about ¾" to 1" is needed to open or close the valve. When lever 34 is in the horizontal, full line position the valve is closed, and water pressure within valve chamber 31 exerts a force resisting downward movement of the lever 34 until the water level 17*b* within casing 20 has dropped sufficiently with respect to float 33 so that the added effective weight of float 33, acting through connecting rod 35 and lever 34 counterbalances said internal pressure; whereupon lever 34 will drop to the dotted line position, and in so doing open the valve to water flow. Conversely, as the water flow again causes water level 17*b* to rise the internal pressure within valve chamber 31 tends to restrict upward movement of lever 34 until the buoyant force of float 33, transmitted through connecting rod 35 to lever 34 is sufficient to counterbalance said internal pressure.

For the water level control unit 10 to work most effectively, in spite of pool activity causing the water level to be wavy as indicated at 17*d*, there should be a small aperture or vent means 25*a* in top wall 25; and it is important that the area of aperture 27 in partition 21 and the combined area of apertures 22 in the casing bottom be sufficient to permit free egress of water entering the casing through valve assemblage 23, while limiting the effect of waves 17*d* on the water level 17*b* within the casing. In other words, the apertured partition 21 and apertures 22 in the casing bottom act as baffles to "dampen" the effect of pool waves 17*d*.

In a period of non-use, when the pool water surface 17 is quiet, an actuation of ball cock valve assemblage 23 will initiate a continuance flow of water to raise the pool water 17 a full ¾" to 1" without interruption. In a period of pool use, and to the extent that it is impossible for the baffle means to "dampen" the effect of waves in the pool, both valve opening and valve closing may take place prematurely, with the result that a single flow of water might raise the surface level 17 only ½ inch or less; or the water supply may be turned on and off repeatedly in quick succession.

These factors are not mentioned as problems, but merely in explanation of how the water level control unit 10 will perform when a need for refill water coincides with a period of active pool use. Indeed, a primary advantage of the unit is its ability to respond to the need during active use, since water loss due to active use can readily develope a need for refill water.

The casing 20 is provided on its outer surface with markings 39, 40, about 1" apart denoting the high and low levels between which the unit is intended to function, and in assembly of the unit it will be apparent that the connecting rod 35 will be properly aligned with float 33 by adjustable means 36. The markings 39, 40 then guide the user in mounting the unit in his pool within the limits previously discussed with respect to proper skimmer functioning.

The internal piping 24 can suitably be a length of metal or plastic tubing having a U-shaped bend 39 with coupling means 40 at its end for securing the same to the valve extension 29. The upper end of piping 24 is securely positioned with respect to the casing top wall 25 as by clamp nuts 41.

The housing and support structure for water level control unit 10 can be widely varied while still providing effective support for the ball cock valve assemblage 23 and internal piping 24, and the baffle means for permitting egress and retarding ingress of water. Thus, for example, a vertically divided housing could engage and support the valve assemblage 23 and piping 24 as the two housing parts are secured together. It is believed, however, that the three part housing illustrated provides an optimum combination of low fabrication costs, ease of assembly, accessibility for adjustment and/or repair, and safety as installed for use.

The elongated casing 20, the partition 21 and the apertured bottom member 22 can readily be molded from plastic materials. As shown the partition seats within an annular recess 42 at the lower end of casing 20, and is provided with a downwardly extending skirt 43 for interfitting with bottom member 22. At spaced points the skirt 43 is interrupted to receive screws or other fastening means 44 for securing together the partition 21 and casing 20 after the valve assemblage 23 and piping 24 have been secured to the partition. Interfitting portions of the skirt 43 and bottom member 22 can be fashioned to provide a snap fit, or the parts can be secured together by screws or other fasteners 45. In either instance the bottom member 22 can readily be removed for repair or adjustment of the inner mechanism.

It will be noted that the unit 10 as shown provides smoothly rounded contours thereby minimizing the possibility of injury if inadvertently bumped by swimmers. Thus, particularly when mounted on a pool ladder as shown it can effectively maintain the desired water level in a pool with virtually no inconvenience to users of the pool.

Various changes and modifications in the water level control for swimming pools as herein disclosed may occur to those skilled in the art, and to the extent that such changes and modifications are embraced by the appended claims, it is to be understood that they constitute part of the present invention.

I claim:

1. A water level control for swimming pools comprising a vertically elongated casing adapted for mounting on a ladder or pool edge, said casing being of interfitting component construction providing a partial horizontal partition dividing the same into upper and lower chambers with free passage of water therebetween, and a partially open bottom permitting water flow to the pool, a ball cock valve and vertically slidable float assemblage secured to said partition and positioned in said upper chamber with the water inlet thereof protruding into said lower chamber and the water outlet thereof being above said partition, said partition having an elongated transverse aperture providing a water passage therethrough, and lateral offsets intermediate the ends of said aperture providing positioning means for said ball cock valve and float assemblage, means detachably coupling said water inlet with a pressure source of water supply, said means comprising conduit means extending downwardly through said partition laterally and upwardly to said water inlet with the upper end of said conduit means protruding from the top of said casing and carrying means for detachable coupling with said pressure source of water supply, and said casing having air vent means communicating with said upper chamber and external side markings aligned with the internal high and low water levels which relate to the closing and opening respectively of said ball cock valve.

2. A water level control as defined in claim 1, wherein the spacing of said external markings is within the range of about $\frac{3}{4}$ inch to 1 inch.

3. A water level control as defined in claim 1, wherein said interfitting components comprise top and bottom casing parts having aligned outer surfaces, and a partition member internally bridging the junction of said top and bottom parts, said partition member seating within an inner peripheral recess in the lower end of said top member, and having a downwardly extending peripheral skirt interfitting with inner surfaces of said bottom member.

4. A water level control as defined in claim 3, wherein said skirt has spaced interruptions receiving fastening means extending vertically through said partition and into said top casing part.

5. A water level control as defined in claim 3, wherein said bottom part is of smoothly domed contour having a plurality of apertures therein of a size and number to permit free egress of water passing through said ball cock valve in the open position thereof while retarding ingress of water due to wave action generated during pool use.

* * * * *